United States Patent [19]

Yamanaka et al.

[11] 4,276,746

[45] Jul. 7, 1981

[54] COMPOUND VALVE DEVICE

[75] Inventors: Minoru Yamanaka; Tooru Tamura, both of Toyota, Japan

[73] Assignee: Aisin Seiki Kabushiki Kaisha, Kariya, Japan

[21] Appl. No.: 9,906

[22] Filed: Feb. 6, 1979

[30] Foreign Application Priority Data

Feb. 10, 1978 [JP] Japan ..... 53/14442

[51] Int. Cl.[3] ..... F01N 3/10

[52] U.S. Cl. ..... 60/290; 123/587; 137/595; 251/28

[58] Field of Search ..... 60/290, 285; 137/595; 251/28, 33; 123/124 R, 119 D, 119 DB, 97 B, 587

[56] References Cited

U.S. PATENT DOCUMENTS

| | | | |
|---|---|---|---|
| 2,211,336 | 8/1940 | Linder | 123/124 R |
| 2,969,800 | 1/1961 | Skirvin | 123/124 R |
| 3,364,909 | 1/1968 | Mick | 123/124 R |
| 3,738,109 | 6/1973 | Tatsutomi | 123/119 D |
| 4,098,241 | 7/1978 | Tateno | 123/124 R |
| 4,154,057 | 5/1979 | Mitsuda | 60/276 |
| 4,191,014 | 3/1980 | Jones | 60/290 |

FOREIGN PATENT DOCUMENTS

| | | | |
|---|---|---|---|
| 1206847 | 8/1959 | France | 137/595 |

*Primary Examiner*—Douglas Hart

*Attorney, Agent, or Firm*—Sughrue, Rothwell, Mion, Zinn and Macpeak

[57] ABSTRACT

A compound valve device comprises a body member, a first valve member being located in the body member and controlling the fluid communication between a first input port and a first output port, and a second valve member being located in the body member and controlling the fluid communication between a second input port and a second output port. The two valve members operate in sequence, without a significant difference in time in response to one signal pressure.

4 Claims, 1 Drawing Figure

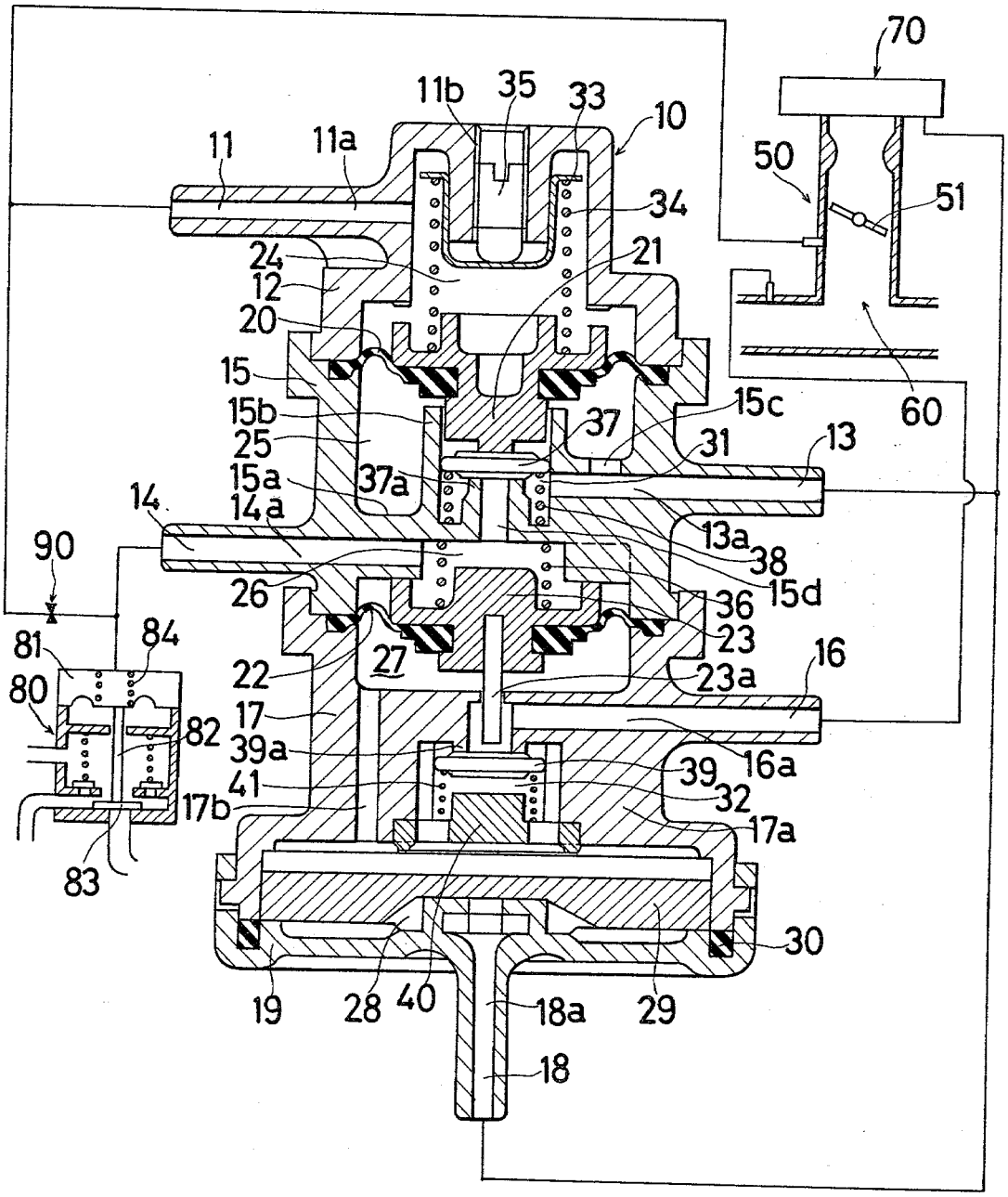
70
11b
35
33
10
11
11a
50
51
34
24
21
12
20
15
15b
15c
37
60
25
31
13
15a
37a
14
14a
13a
90
38
26
15d
36
81
84
23
80
22
27
23a
16
17
82
39a
16a
41
39
32
17b
17a
83
30
19
28
40
18a
29
18

COMPOUND VALVE DEVICE

BACKGROUND OF THE INVENTION

1. Field of the Invention

This invention relates to compound valve devices in general, and more particularly to compound valve device for use in an exhaust gas control system for internal combustion engines.

2. Description of the Prior Art

In generally, an exhaust gas purification system, in case of controlling the pressures of various utilization means, needs as many valve devices as the various utilization means. As a result, the above system always includes undesirable problems which are complicated in system and high in cost. In order to solve the above problems, a compound valve device which operates two valve means in response to one signal pressure has been proposed. However, since a conventional valve device of this type has construction wherein two valve means are positioned axially, there is a drawback in that the operation of the two valve means have a difference in time in the opening and closing operation of the two valve means. Accordingly, when the conventional valve device is applied for use in an exhaust gas purification system of the internal combustion engine and so on, the system is not controlled surely and reliability in operation is reduced.

SUMMARY OF THE INVENTION

It is a principal object of the present invention to provide a compound valve which eliminate the drawbacks of the conventional compound valve device.

It is another object of the present invention to provide a compound valve device which operates two valve means in sequence without a significant difference in time in response to one signal pressure.

It is still another object of the present invention to provide a compound valve device which is simple in construction, economical to manufacture, and thoroughly reliable in operation.

Other objects and their attendant advantages will become apparent as the following detailed description is read in conjunction with the accompanying drawing.

DESCRIPTION OF THE DRAWINGS

The drawing is a schematic of an exhaust gas control system in internal combustion engines incorporating the compound valve device in accordance with the present invention.

DETAILED EXPLANATION OF THE INVENTION

Referring now to the drawing, a compound valve device of the present invention is shown by numeral 10. The valve device 10 comprises a first body 12 having a first input port 13 and a first output port 14, a third body 17 having a second output port 16, and a fourth body 19 having a second input port 18. The first and second bodies 12 and 15, the second and third bodies 15 and 17, and the third and fourth bodies 17 and 19 are combined securely, respectively, in a suitable connection system such as supersonic waves welding. Rigidly secured between the first and second bodies 12 and 15 is a first flexible diaphragm 20 which has centrally connected thereto a first diaphragm piston 21. Rigidly secured between the second and third bodies 15 and 17 is a second flexible diaphragm 22 which has centrally connected thereto a second diaphragm piston 23. Both the first and second diaphragms 20 and 22 are made of rubber or other flexible material to enable movement of the center portion thereof in response to pressure changes. A first signal chamber 24 and a first atmospheric chamber 25 are formed by the first diaphragm 20 within the first and second bodies 12 and 15, respectively. A second signal chamber 26 and a second atmospheric chamber 27 are formed by the second diaphragm 22 within the second and third bodies 15 and 17, respectively. Formed between the third and fourth bodies 17 and 19 is a third atmospheric chamber 28 where an air filter assembly 29 is positioned. A sealing member 30 made of rubber is positioned in the peripheral portion of the fourth body 19 in order to prevent fluid leakage. The second body 15 is provided with an isolating wall **15*a* having an upstanding hollow stem 15*b* defining a first valve chamber 31 therewithin. The third body 17 is provided with an isolating wall 17*a* defining second valve chamber 32**.

The first signal chamber 24 is connected by means of a passageway **11*a* and the signal port 11 to an engine intake manifold 60 which is downstream from a throttle valve 51 of a carburetor 50 and supplies a vacuum source hereinafter referred to as the manifold vacuum. The first valve chamber 31 is connected by means of passageway 13*a* and the first input port 13 to an air cleaner 70. The second signal chamber 26 is connected by means of a passageway 14*a* and the first output port 14 to a signal chamber 81 of an air switching valve 80. At the same time, the signal chamber 81 is connected by means of an orifice 90 to the intake manifold 60. The second valve chamber 32 is connected to the air cleaner 70 by means of the third atmospheric chamber 28, a passageway 18*a* and the input port 18. A passageway 16*a* formed in the third body 17 is connected by means of the second output port 16 to the intake manifold 60. The second atmospheric chamber 27 is connected by means of a passageway 17*b* to the third atmospheric chamber 28**.

A coil spring 34 is axially positioned within the first signal chamber 24. One end of the spring 34 engages a thrust washer 33, while the other end of the spring 34 abuts the first diaphragm piston 21, thereby always biasing the piston 21 downward. The axial position of the thrust washer 33 is adjustable by means of an adjusting screw 35 to vary the degree of compression in the spring 34. The screw 35 extends through a threaded aperture **11*b* in the first body 11. A coil spring 36 is axially positioned within the second signal chamber 26. One end of the spring 36 engages the isolating wall 15*a*, while the other end of the spring 36 abuts the second diaphragm piston 23, thereby always biasing the piston 23** downward.

Located within the first valve chamber 31 is a first valve member 37 which is in contact with a valve seat **37*a* projecting from the isolating wall 15*a*, thereby controlling the fluid communication between the first input port 13 and the first output port 14. The first valve member 37 is normally held to be contact with the valve seat 34*a* by the biasing force of the spring 34, thereby maintaining the valve member 37 in the close position. When the vacuum in the first signal chamber 24 increases and reaches the predetermined vacuum valve, the diaphragm piston 21 moves upward overcoming the biasing force of the spring 34, whereby the first valve member 37 is spaced above the valve seat 37*a* by the biasing force of a valve spring 38** and is maintained in the open position.

Located within the second valve chamber 32 is a second valve member 39 which is in contact with a valve seat 39*a* projecting from the isolating wall 17*a*, thereby controlling the fluid communication between the second input port 18 and the second output port 16. The second signal chamber 26 is normally provided with the vacuum from the intake manifold 60 by means of the first output port 14. As a result, since the diaphragm piston 23 moves upward, the second valve member 39 is normally in contact with the valve seat 39*a* by the biasing force of a valve spring 41 and is maintained in the closed position. Under this condition, when the first valve member 37 moves to the open position, the air in the air cleaner 70 is transmitted to the second signal chamber 26 through a passageway 15*d* formed in the isolating wall 15*a*. As a result, since the diaphragm piston 23 moves downward by the biasing force of the spring 36, the second valve member 39 is spaced from valve seat 39*a* by a shaft 23*a* fixed in the diaphragm piston 23 and is maintained in the open position. That is to say, the first and second valve members 37 and 39 operate in sequence without any significant difference in time in response to the signal pressure supplied to the signal port 11.

The above-mentioned air switching valve 80, as it is universally known, constitutes an important part of the air injection system in the internal combustion engine. In the air injection system the air switching valve 80 supplies the pressured air transmitted from an air pump (not shown) to an engine exhaust manifold (not shown) and the air cleaner 70 in response to the operating state of the engine. By means of detecting the manifold vacuum transmitted from the intake manifold 60 to a signal chamber 81, a valve member 83 connected with a diaphragm piston 82 controls the above mentioned pressurized air from the air pump in response to the operating state of the engine.

During rapid deceleration in an internal combustion engine, in general, the intake manifold vacuum increases rapidly. Accordingly, the liquid fuel on the internal surface of the intake manifold 60 evaporates and is sucked into the combustion chamber (not shown) of the engine, whereby the air-fuel mixture is enriched. Since imperfect combustions and accidental fires occurs due to the above mentioned enriched air-fuel mixture, large amounts of undesirable exhaust gas elements such as HC and CO are produced. Therefore, in order to prevent this phenomenon and to reduce the amount of exhaust gas emissions of undesirable elements, it is necessary to supply air to the intake manifold 60 and to maintain a proper air-fuel ratio. Furthermore, since the air-fuel ratio becomes too rich during rapid deceleration of the engine, as stated previously, the fuel is discharged into the exhaust manifold without perfect combustion. As a result, the so-called after burn phenomenon occurs easily and frequently. In particular in the internal combustion engine adopting an air injection system, since there is a proper combustible air-fuel ratio in the exhaust manifold, the after burn phenomenon occurs more easily and more frequently. Accordingly, in order to get rid of the above-mentioned phenomenon, it is necessary to cut off supplying air for a time to the exhaust manifold during rapid deceleration of the engine.

In operation of the above-mentioned exhaust gas control system, during rapid deceleration of the engine, the intake manifold vacuum increases rapidly. The manifold vacuum is transmitted through the signal port 11 to the first signal chamber 24. When the vacuum in the signal chamber 24 increases and reaches a predetermined vacuum value, the first valve member 37 is maintained in the open position. As a result, since the air in the air cleaner 70 is transmitted through the first input port 13 and the first output port 14 to the signal chamber 81 of the air switching valve 80, the valve member 83 is maintained in the closed position by the biasing force of the spring 84. Accordingly, the supply of pressurized air from the air pump is cut off to the exhaust manifold. By the way, when the first valve member 37 moves to the open position, the air in the air cleaner 70 is transmitted to the second signal chamber 26 simultaneously, and then the second valve member 39 moves to the open position. As a result, the air in the air cleaner 70 is transmitted through the second input port 18 and the second output port 16 to the intake manifold 60. That is to say, this exhaust gas control system cuts off supplying the pressurized air to the exhaust manifold and conducts the air to the intake manifold 60 substantially, namely, without any significant difference in time, thereby reducing the amount of exhaust gas emissions of undesirable elements and preventing the after burn phenomenon.

The compound valve device 10 of the above-mentioned embodiment has a mechanism whereby the second valve member 39 moves to the open position when the first valve member 37 moves to the open position, however, it is easy to construct a mechanism wherein the second valve member 39 moves to the closed position when the first valve member37 moves to the open position.

It will be apparent to those skilled in the art that the valve of the invention may be constructed in a variety of ways without, however, departing from the scope and spirit of the appended claims.

What is claimed is:

1. A compound valve device comprising:

a body member means having a signal port, a first input port connected to an air cleaner, a first output port, a second input port connected to said air cleaner, and a second output port;

a first diaphragm forming a first signal chamber and a first atmospheric chamber within said body member means, said first signal chamber connected to said signal port, said first atmospheric chamber being connected to said first input port, said first diaphragm being movable in response to the signal pressure in said signal chamber;

a first valve member controlling the atmospheric communication between said first input port and said output port by the movement of said first diaphragm;

a second diaphragm forming a second signal chamber and a second atmospheric chamber within said body member means, said second signal chamber connected to said first output port, said second atmospheric chamber being connected to said second input port, said second diaphragm being movable in response to the pressure in said second signal chamber; and a second valve member controlling the atmospheric communication between said second input port and said second output port by the movement of said second diaphragm, said second valve member being operated immediately after the operation of said first valve member in response to the signal pressure in said signal port.

2. A compound valve device according to claim 1 further comprising a first spring means and a second spring means, said first spring means being located in said first signal chamber and biasing said first diaphragm, said second spring means being located in said second signal chamber and biasing said second diaphragm.

3. A compound valve device according to claim 1 wherein said signal port is connected to an engine intake manifold, said first output port is connected to a signal chamber of an air switching valve, and said second output port is connected to said engine intake manifold.

4. A compound valve device according to claim 1 wherein said first valve member abuts said first diaphragm and said second valve member abuts said second diaphragm.

* * * * *